United States Patent [19]

Dennis

[11] Patent Number: 4,516,609

[45] Date of Patent: May 14, 1985

[54] CROSS STITCH RIBBON

[76] Inventor: Linda H. Dennis, 519 E. Main St., Spartanburg, S.C. 29302

[21] Appl. No.: 589,043

[22] Filed: Mar. 14, 1984

Related U.S. Application Data

[63] Continuation of Ser. No. 343,444, Jan. 28, 1982, abandoned.

[51] Int. Cl.[3] ..... D03D 3/00; D03D 25/00; D05C 17/00

[52] U.S. Cl. ..... 139/383 R; 139/385; 139/416; 139/420 R; 112/439; 112/266.1

[58] Field of Search ..... 139/383 R, 416, 420 R, 139/385; 112/439, 266.1, 402

[56] References Cited

U.S. PATENT DOCUMENTS

| | | | |
|---|---|---|---|
| 377,141 | 1/1888 | Browne | 139/416 |
| 725,112 | 4/1903 | Merrow | 112/439 X |
| 1,406,208 | 2/1922 | Miller | 139/416 |
| 1,702,289 | 2/1929 | Zimmerer, Jr. | 139/385 X |
| 2,260,052 | 10/1941 | Passavant | 139/420 R |
| 2,939,491 | 6/1960 | Ballard | 139/383 R |
| 4,098,210 | 7/1978 | Wright | 112/439 |
| 4,160,057 | 7/1979 | Kogan et al. | 139/420 R |

FOREIGN PATENT DOCUMENTS

| | | | |
|---|---|---|---|
| 45-10777 | 4/1970 | Japan | 112/439 |
| 726990 | 3/1955 | United Kingdom | 139/416 |
| 946610 | 1/1964 | United Kingdom | 139/383 R |

*Primary Examiner*—James Kee Chi

*Attorney, Agent, or Firm*—Bailey & Hardaway

[57] ABSTRACT

A fabric for threaded embellishments is formed of a plain consistent weave having no more than 60 warp threads with a continuous filling thread so as to permit a needle and thread embellishment through the interstices thereof.

10 Claims, 3 Drawing Figures

CROSS STITCH RIBBON

This application is a continuation of application Ser. No. 343,444 filed Jan. 28, 1982, now abandoned.

BACKGROUND OF THE INVENTION

This invention relates generally to the art of fabric embellishments utilizing a needle and thread, and more particularly, to a novel fabric construction for such embellishments.

Various fabrics have been utilized throughout history for needle and thread embellishments. Such embellishments are identified by various names, depending on the types of stitches utilized. Examples of such embellishments include needlepoint, cross stitch, and back stitch. Other techniques of interlacing a thread through the interstices of a fabric have also been devised. These needle and thread embellishments are conventionally carried out on large consistent weave fabrics which are suitable for ultimate framing or attachment to other fabrics for use in furniture or other ornamental purposes.

U.S. Pat. No. 3,040,332 to Kleinwald describes a process for producing embroidery designs utilizing a face fabric and a base fabric which sharply delineates the underlying embroidery design.

U.S. Pat.No. 1,581,936 to Lehmann discloses an embroidery pattern wherein individual stitches are extremely close together to conceal the base fabric. This result is brought about by the angularity and the thickness of thread utilized to produce the embroidery.

U.S. Pat. No. 1,333,687 to Strasburger discloses an open wire net which is embellished with threads by working the threads through the interstices of the net. The net is rigid in comparison to fabrics which are normally utilized for such embellishment.

U.S. Pat. No. 2,342,569 to Bernstein discloses a method of making button and button hole strips for plackets. The strips are prepared by embroidering a large piece of fabric with a series of embroidery stitches. Alternating strips are provided respectively with embroidery for button holes and embroidery marking for buttons in alignment therewith. The strips are severed from one another so as to provide individual strips for plackets. Individual strips thus have either discontinuous warp threads or filling threads which are prevented from unraveling by the edge embroidery thereof.

U.S. Pat. No. 2,098,259 to Schifter discloses a double thread cross stitched embroidered fabric having embroidery comprising successively interconnected stitches presenting on one face of the fabric stitches disposed in spaced parallel rows and cross stitches disposed transversely of the spaced parallel rows which intersect each other and interconnect with each other on the reverse side of the fabric.

U.S. Pat. No. 4,075,962 to Mabry discloses a needlework canvas through which a ribbon is interlaced for embellishment. The canvas is completely covered between predetermined margins.

While many specialized forms of stitching and embellishment are described above, they are all adapted for use on relatively large backings which are ultimately cut or trimmed to a suitable size.

SUMMARY OF THE INVENTION

It is thus an object of this invention to provide a novel fabric for use in forming threaded embellishments.

It is a further object of this invention to provide such a fabric which provides a limited space for embellishment in one dimension with a variable space for embellishment in a second direction and is adaptable to a variety of applications and ornamentations.

These as well as other objects are accomplished by a fabric for threaded embellishments comprised of a plain consistent weave having no more than 60 warp threads and a continuous filling thread. The fabric of this invention is of open weave to permit needle and thread embellishments through the interstices of the fabric.

DETAILED DESCRIPTION

In accordance with this invention, it has been found that a fabric with a particular limited extent in one direction but with a generally unlimited extent in a second direction provides a fabric for embellishment with needle and thread with advantages not heretofore possessed by prior art fabrics. The fabric of this invention is of a consistent weave such that the distance between interstices in the direction of limited extent is the same as the distance between interstices in the direction of unlimited extent. Such an arrangement permits intricate needle and thread embellishments or embroidery to be formed within a limited area and thus permits such embellishments to be performed with a minimum of effort while permitting advantageous display of such embellishments. Due to the limited extent in one dimension of the fabric of this invention, it has many useful features either with or witout embellishments. For example, such fabric may be used as an embellishment itself on clothing and other personal objects. Additionally, the fabric of this invention may be interwoven with other fabric in accordance with this invention to form objects which are embellished not only by the fabric of this invention, but also by the needle and thread embellishments thereon. Further details of the fabric of this invention and its utilization are given in the following description with reference to the various Figures of drawing.

Figure 1:
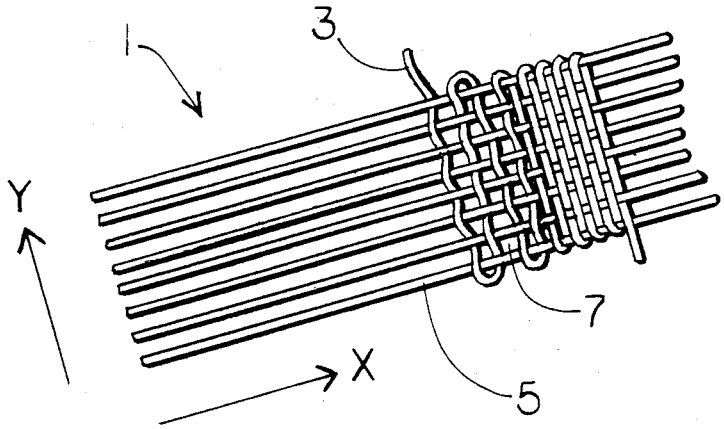
FIG. 1 of the drawing illustrates a fabric in accordance with this invention.

FIG. 1 of the drawings illustrates the fabric of this invention and for purposes of discussion defines a y direction which is the dimension of limited extent and the x direction which is the dimension of generally unlimited extent. The y direction in weaving terminology is the direction in which the filling thread is woven while the x direction is defined by the warp threads. Additionally the filling thread is frequently referred to as the weft thread or the woof. For purposes of this disclosure, however, the particular thread which is woven from a shuttle is referred to as the filling thread.

FIG. 1 thus depicts a fabric 1 having a filling thread 3 and warp threads generally referred to as 5. It will be noted that the various intersections between filling threads 3 and warp threads 5 define interstices 7 through which an embellishing thread can pass for purposes of forming embellishing ornamentation thereon. Additionally filling thread 3 is continuous such that any piece of fabric in accordance with this invention has only two ends for the filling thread and each of the warp threads. In accordance with this invention, the filling thread is always continuous and never severed in the edge areas. Such severance renders the product unsuitable for needle and thread embellishment in that the rigors of such embellishment would unravel the woven product. Severed edges additionally would not produce the self-framing characteristic which the fabric of this invention possesses.

As discussed above, interstices 7 are formed by the intersection of filling thread 3 and warp threads 5. Such interstices must be evenly spaced both in the y direction and the x direction in order for needle and thread embellishment to be performed in an even manner. For this reason, the filling thread must be of the same size as each of the warp threads. The weave must be open so as to form an interstice of 0.1 to 0.35 square millimeters so as to permit the passage therethrough of needles carrying embellishing threads. For example, the interstice size must be sufficiently large to permit the passage therethrough of a size 24 or 26 tapestry needle.

It is contemplated, however, within the scope of this invention that each filling thread 3 and warp thread 5 may comprise a plurality of threads with the number forming the plurality of filling threads being equal to the number of plurality in warp threads. A preferred fabric in accordance with this invention comprises a plurality of two with each plurality being generally closed such that interstices exist only at the intersection formed by warp threads 5 in the x direction and filling threads 3 in the y direction.

It is essential to the functionality of this invention that the number of warp threads not exceed 60 and that the extent of the fabric in the y direction be no greater than two inches. This produces a fabric for embellishment in the nature of a ribbon which may be suitably embellished and used like a ribbon but additionally used in the same manner as fabrics conventionally embellished or embroidered with needle and thread. While it has been stated that the number of warp threads should not exceed 60, that number is arrived at utilizing the number of threads required to form an interstice. Thus when doublets or triplets of threads are utilized for the filling and warp threads, each doublet or triplet counts as a single thread in determining the number of warp threads.

For purposes of defining the scope of this invention, a maximum number of warp threads is stated to be substantially 60 with a maximum width of substantially 2 inches so as to encompass any slight variations in such numbers. A minimum width in accordance with this invention is generally about 1 inch so as to permit needle and thread embellishment in the confined area. A thread density counting threads as above described in accordance with this invention is within the range of from about 20 to 30 threads per inch.

Figure 2:
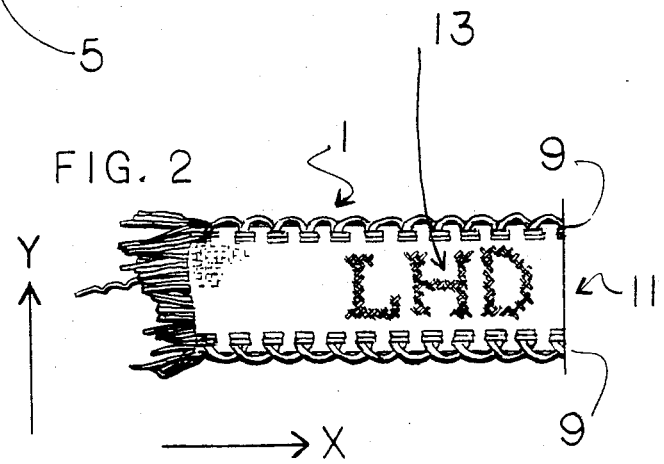
FIG. 2 is a fabric in accordance with this invention having selvage areas depicted thereon as well as embellishments thereon.

FIG. 2 of the drawings illlustrates a fabric in accordance with this invention wherein the fabric is formed of a plurality of two warp threads and two filling threads having selvage areas 9 on each lateral edge with a central work section of a plain consistent weave 11 in the central section. It is contemplated that such central work section should have no more than 40 warp threads with the remaining threads forming the selvage areas. Such selvage areas are generally and preferably of a different weave for ornamentation purposes and may be of differing color and composition from the central work section 11. Such selvage areas may be formed in a manner so as to complement the needle and thread embellishment in the central work section thereof. Such selvage may, for example, be in the form of lace, scallop or combinations thereof. Also shown in FIG. 2 is a needle and thread embellishment 13 in the central work section 11 of the fabric 1 in accordance with this invention.

A preferred form of the fabric comprises a scallop trim with 40 warp thread doublets of spun polyester thread forming the work section and 8 warp thread doublets cotton on each edge forming the selvage.

It is thus seen that the fabric in accordance with this invention provides a limited extent in one direction so as to provide a framing or displaying area for intricate needle and thread embellishment. Such a product has many uses since the dimension with an unlimited extent may be provided with many embellishments. For example, the embellished product may be utilized for ornamentation on pillow covers, pocketbooks, clothing and other personal objects. Additionally, the product may be utilized as napkin holders or belts.

Figure 3:
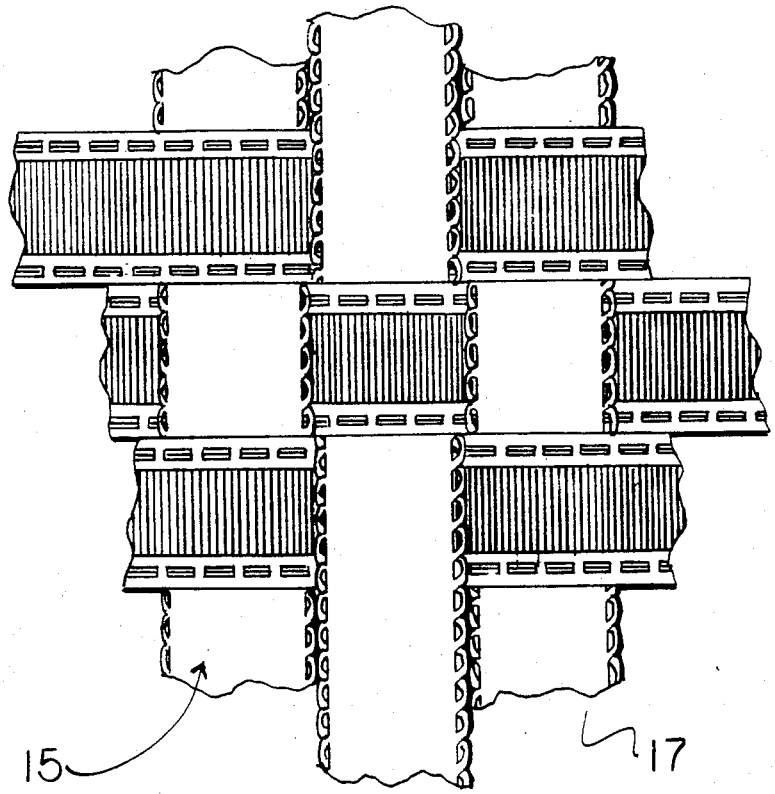
FIG. 3 of the drawings illustrates a larger fabric formed from interwoven segments of the fabric in accordance with this invention.

A further embodiment of this invention is illustrated in FIG. 3 of the drawings wherein a plurality of embellished fabrics in accordance with this invention are interwoven so as to provide an extremly unique appearing fabric with or without individual embellishment on each segment 15 of the overall fabric 17.

It is thus seen that the fabric of this invention provides a novel fabric for embellishment and provides a fabric with a limited extent in one direction, thus permitting detailed and intricate embellishment to be displayed in a well framed area. The thus embellished fabric is capable of many and diverse applications being limited only by the imagination of the user. While many specific embodiments are described above, such embodiments are exemplary in nature with the spirit and scope of the invention being limited only by the following appended claims.

That which is claimed is:

1. A fabric for threaded embellishments, comprising:

a plain consistent weave fabric having no more than sixty (60) warp threads with a continuous filling thread, each of said warp threads forming with said continuous filling thread interstices of sufficient size to permit a needle to pass therethrough;

said fabric having a warp direction defined by said warp threads and a weft direction defined by said filling thread and wherein the distance between said interstices in the warp direction is substantially the same as the distance between interstices in the weft direction;

said fabric being of an open weave to permit needle and thread embellishments through the interstices of said fabric and further comprising a threaded embellishment woven by needle and thread through some of said interstices, said plain consistent weave fabric being substantially no wider than two inches.

2. The fabric according to claim 1 wherein each said warp thread comprises a plurality of threads and said filling thread comprises an equal plurality of threads so as to maintain said consistent plain weave.

3. The fabric of claim 2 wherein said plurality is two.

4. The fabric according to claim 1 wherein said fabric comprises selvage areas along each longitudinal edge with woven embellishment within said selvage areas thereof formed from said warp threads and said filling thread.

5. The fabric according to claim 4 wherein the area between selvage areas comprises no more than 40 warp threads.

6. The fabric according to claim 1 wherein said fabric comprises a central consistent weave work section and outer selvage areas and said selvage areas are of a differing color and weave from said central work section.

7. The fabric according to claim 6 wherein said central work section comprises no more than 40 warp threads.

8. The fabric according to claim 7 wherein said work section comprises polyester warp threads and said selvage areas comprise cotton warp threads.

9. The fabric according to claim 7 further comprising threaded embellishments interwoven through the interstices of said central work section.

10. A fabric formed of a plurality of fabric segments in accordance with claim 9 interwoven to form a larger fabric.

* * * * *